United States Patent [19]

Eschbaugh et al.

[11] 3,967,782

[45] July 6, 1976

[54] REFRIGERATION EXPANSION VALVE

[75] Inventors: John T. Eschbaugh, Chesterland, Ohio; Herbert S. Lindahl, Danville, Ill.

[73] Assignee: Gulf & Western Metals Forming Company, Southfield, Mich.

[22] Filed: Mar. 23, 1971

[21] Appl. No.: 127,174

Related U.S. Application Data

[63] Continuation-in-part of Ser. No. 733,946, June 3, 1968, abandoned.

[52] U.S. Cl. ..... 236/92 B; 62/225; 251/282

[51] Int. Cl.[2] ..... G05D 27/00

[58] Field of Search ..... 62/225; 236/92 B; 251/282

[56] References Cited

UNITED STATES PATENTS

| | | | |
|---|---|---|---|
| 2,051,971 | 8/1936 | Swart | 62/225 |
| 2,052,769 | 9/1936 | Hoesel | 236/92 B |
| 2,148,413 | 2/1939 | Labberton et al. | 236/92 B |
| 2,897,836 | 8/1959 | Peters et al. | 251/282 X |
| 2,937,505 | 5/1960 | Merrell | 251/282 X |
| 2,967,403 | 6/1961 | Lange et al. | 236/92 B X |
| 3,189,277 | 6/1965 | Fox | 251/282 X |
| 3,194,499 | 7/1965 | Noakes et al. | 236/92 B |
| 3,246,840 | 4/1966 | Matthies | 236/92 B |
| 3,402,566 | 9/1968 | Leimbach | 62/225 X |
| 3,537,645 | 11/1970 | Treder | 62/210 X |

OTHER PUBLICATIONS

Air Conditioning & Refrigeration Business, May, 1969, Industrial Publishing Co.

"A New Concept in Outdoor Systems," Jan., 1969, Bohn Aluminum & Brass Co.

*Primary Examiner*—Kenneth W. Sprague
*Assistant Examiner*—James C. Yeung
*Attorney, Agent, or Firm*—Whittemore, Hulbert & Belknap

[57] ABSTRACT

A refrigeration system has the system condenser exposed to the normal outdoor ambient temperature. The control means includes a single balanced expansion valve having a maximum port opening which is oversized as compared to that required only for normal summer operation, and the valve is actuated to provide a much larger increase in port opening under winter conditions than have heretofore been used. The result is that the system operates without adjustment or modification over an exceptionally wide range of condenser ambient temperature. The balanced valve is actuated by motor means responsive to evaporator outlet temperature and an evaporator pressure condition such as inlet or outlet pressure. The valve element may be slightly over or under balanced to provide predetermined operating characteristics.

6 Claims, 10 Drawing Figures

INVENTORS
JOHN T. ESCHBAUGH
HERBERT S. LINDAHL

BY Whittemore Hulbert & Belknap ATTORNEYS

INVENTORS
JOHN T. ESCHBAUGH
HERBERT S. LINDAHL

BY Whittemore, Hulbert & Belknap ATTORNEYS

INVENTORS
John T. Eschbaugh,
BY Herbert S. Lindahl,
Whittemore, Hulbert
& Belknap
ATTORNEYS Expansion Valve Flow Capacity Lbs/Min R502
Vs. Pressure Drop Across Expansion Valve
Orfice Opening At -20°F Suction Temperature

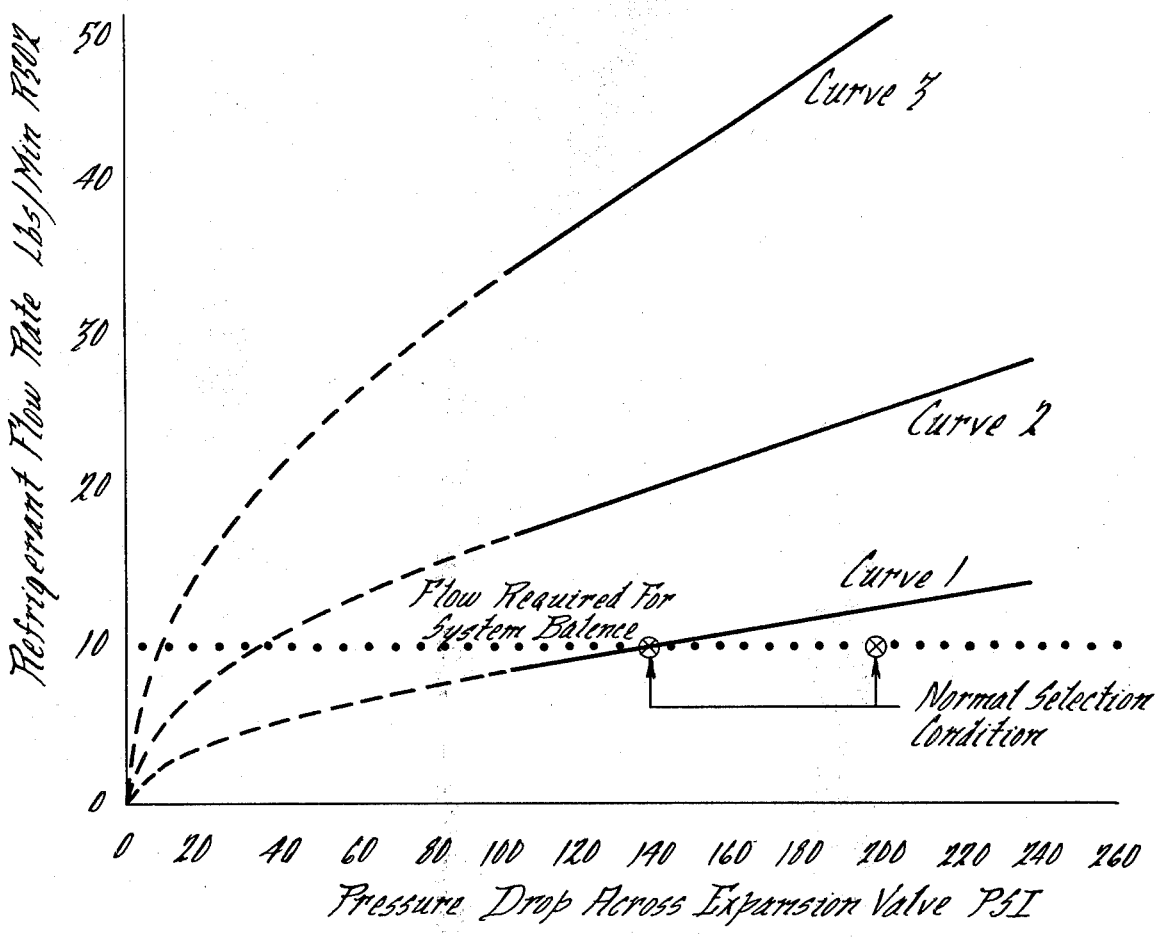

Curve 1-Conventional Effective Port Opening Nominal 2 Ton TEV
Curve 2-Effective Port Opening 2 Times Conventional Nominal 2 Ton TEV
Curve 3-Effective Port Opening 4 Times Conventional Nominal 2 Ton TEV

FIG. 7.

INVENTORS
John T. Eschbaugh,
By Herbert S. Lindahl,
Whittemore, Hulbert & Belknap
ATTORNEYS.

FIG. 8.
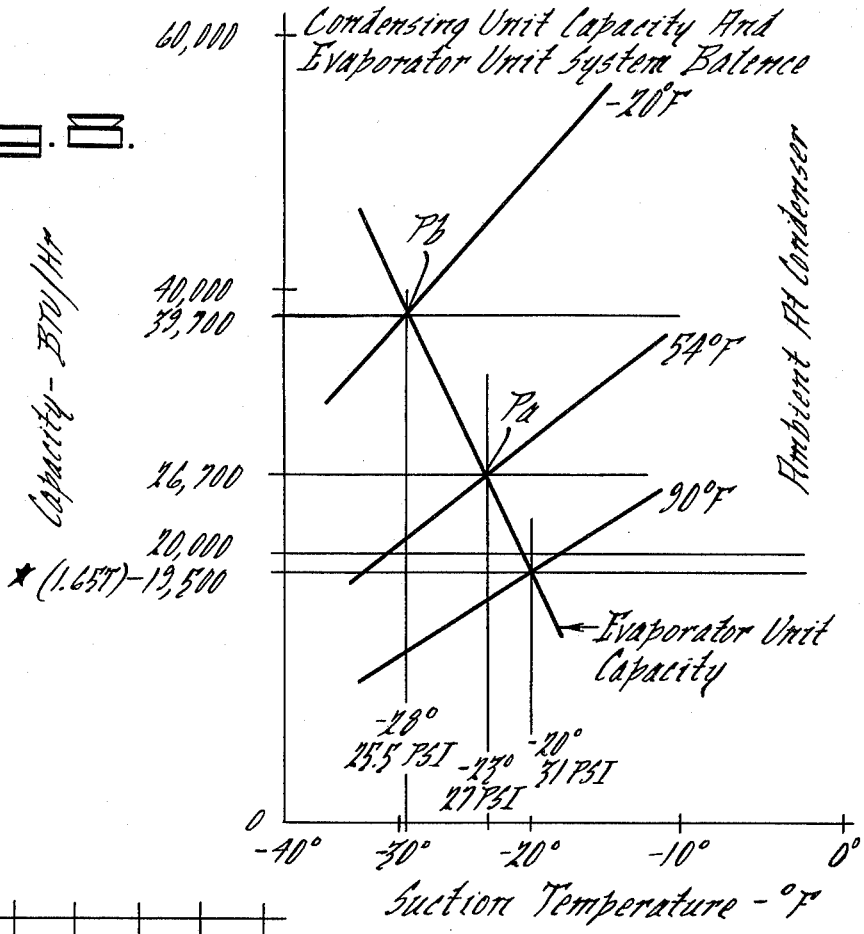
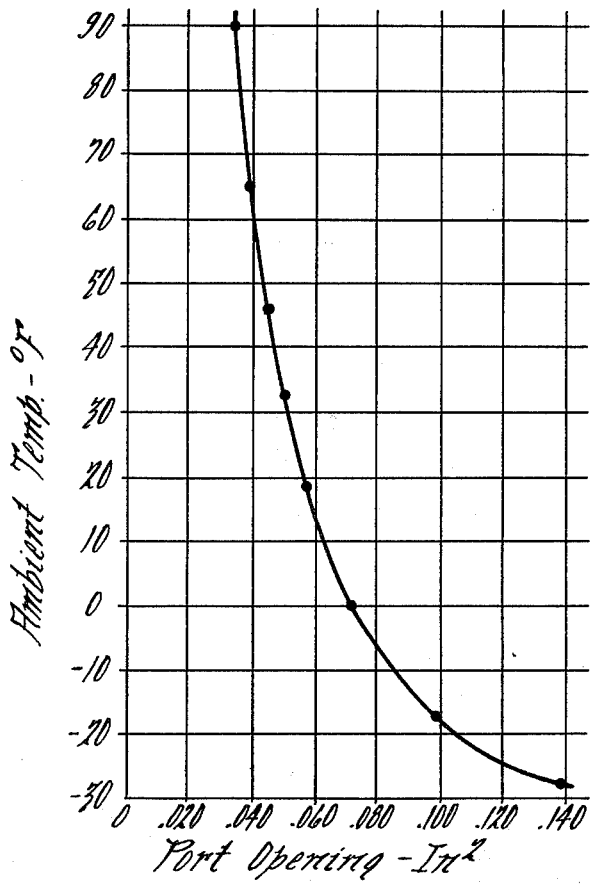
FIG. 9.
INVENTORS
John T. Eschbaugh,
By Herbert S. Landahl,
Whittemore, Hulbert & Belknap
ATTORNEYS.

INVENTORS.
John T. Eschbaugh,
By Herbert S. Lindahl,
Whittemore, Hulbert & Belknap
ATTORNEYS.

REFRIGERATION EXPANSION VALVE

CROSS-REFERENCE TO RELATED APPLICATION

The present application is a Continuation-in-Part of our prior copending application Ser. No. 733,946, filed June 3, 1968, abandoned.

BRIEF SUMMARY OF THE INVENTION

Prior to the present invention, an expansion valve having a properly sized metering orifice for summer operation with a pressure differential thereacross, for example, of 100 pounds per square inch, would not operate to regulate the refrigerant flow therethrough with a pressure differential thereacross of, for example, 2 pounds per square inch, in the winter, as accomplished by the present system.

In accordance with the present invention there is provided a refrigerator system including the usual series loop containing a compressor, condenser and evaporator in which refrigerant flow is controlled by an expansion valve positioned adjacent the inlet to the evaporator. The expansion valve is balanced or may have an increment of unbalance if desired, and has an oversized maximum port opening and operating characteristics whereby efficient control of refrigerant flow from the condenser to the evaporator is maintained with the condenser exposed to year round outdoor ambient temperature. The expansion valve is controlled by motor means responsive to temperature in the suction line from the evaporator and an evaporator pressure condition such for example as pressure at the outlet from the evaporator. In one modification the temperature and pressure responsive means may be located directly in the suction line to improve the response time of the expansion valve.

The essential difference of the present system over those previously known is that the design and control of the expansion valve is related to the system to provide for a much wider variation in port opening than has heretofore been obtained. This is rendered possible by using a maximum port opening in the valve much greater than has heretofore been conventional, as for example from two to four times larger or more as compared to thermal expansion valves designed for comparable capacity.

Prior to the present invention, under winter conditions, when the outside ambient temperature is relatively low, the small available pressure drop across the expansion valve has led to a system in which insufficient refrigerant flows to the evaporator. This in turn means that less than the entire capacity of the evaporator is being used. For example, all of the refrigerant may be evaporated within the first half of the evaporator, leading to conditions in which the temperature difference between air entering the evaporator and the refrigerant temperature in the evaporator coil is such as to cause heavy frost to form on a portion of the coil which reduces performance of the evaporator. At the same time, this condition results in increased superheat of the evaporated refrigerant.

Under operations as controlled by the present invention, the flow of refrigerant is maintained at a level such that the refrigerant is completely evaporated only at or adjacent the outlet to the evaporator. The evaporator coils are thus always effective in cooling and the most efficient overall operation of the system is maintained.

The relatively great increase in port opening may be specified as requiring a port opening under outside temperature conditions of 0° F. which is at least twice the port opening when the outside temperature is 90° F.

BRIEF DESCRIPTION OF THE DRAWINGS

FIGS. 7 an 8 are charts used in explanation of selection of expansion valves.

FIG. 9 is a chart illustrating the proportional change in relationship of effective valve opening in accordance with variations in ambient temperatures at the condenser and corresponding pressure drops across the expansion valve.

DETAILED DESCRIPTION

Figure 1:
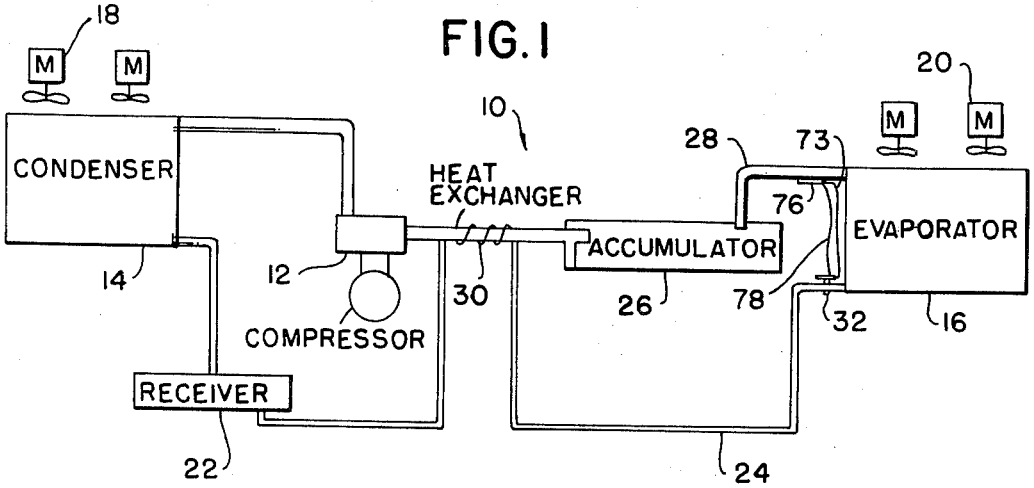
FIG. 1 is a diagrammatic representation of a refrigeration system constructed in accordance with the invention.

The refrigeration system 10, illustrated in FIG. 1, includes the compressor 12, condenser 14, and evaporator 16 connected in a series loop refrigeration cycle. As shown, in the condenser 14 and evaporator 16, fans 18 and 20 are provided for passing air over the condenser 14 and evaporator 16, respectively.

The refrigeration system 10 further includes the receiver 22 in the conduit 24 connected between the condenser 14 and evaporator 16 and a refrigerant accumulator 26 connected in the suction line 28 from the evaporator 16 to the compressor 12. A heat exchanger 30 is connected in the conduit 24 between the condenser and evaporator, as shown. The receiver 22, accumulator 26 and heat exchanger 30 are not required in the refrigeration system 10.

The refrigeration system 10 is completed by the expansion valve 32 positioned in the conduit 24 between the condenser 14 and evaporator 16. In accordance with the invention, the expansion valve 32 is a balanced or nearly balanced valve whereby efficient control of refrigerant flow therethrough is provided during both winter and summer operation with the condenser 14 exposed to outdoor ambient temperatures. Expansion valve 32 is operable in response to the temperature and pressure in the suction line 28 and in fact, the motor means for actuation of the valve 32 may be located in the suction line 28.

Wide temperature ranges at the condenser 14 such as might occur from winter to summer operation effect the condensing pressure. As an example, at 100° F. outdoor ambient, the condensing temperature might be 120° F. or for refrigerant R12 at a pressure of about 158 psig at the condenser 14. If the outdoor ambient were 20° F. the condensing temperature would then change to about 40° F. or 37 psig pressure at the condenser 14. Assuming that the desired condition at the outlet of evaporator 16 for both outdoor conditions is 20° F. or 21 psig, the pressure differential across the expansion valve and evaporator outlet is then 137 psi during one case and 16 psi during the other case.

Efficient operation of the disclosed expansion valve 32 is due to the provision of the balanced construction which provides a balance of forces applied to the movable valve element by refrigerant pressure at the high and also preferably the low side of the valve so as not to effect the forces of the motor means and the opposing superheat spring 60. This balanced construction provides the ideal dynamic balance of forces so that the expansion valve 32 is capable of responding accurately to properly feed the evaporator 16 automatically with variable wide pressure differentials and with a predetermined or fixed setting of the controlling superheat spring 60.

It will be understood that the port opening is determined by movement of a valve element relative to a port, and that with a circular port in which a flat valve element is movable toward and away from the port, the port opening is equal to the circumference of the port multiplied by the distance between the valve element and the valve seat determined by the port. Variations are of course possible such as variously shaped extensions located within the ports. Also, different types of valves, such as those with the valve element slidable across the port may be used.

As used herein, the term maximum valve opening is to be understood as defining the area of the valve opening under the system conditions which produce the maximum movement of the valve element in opening direction. The numerical value of valve opening is of course determined by movement of the valve element, and the size and shape of the valve port, and in some cases the configuration of the valve element.

The disclosed expansion valve 32 has a maximum port opening as for example twice and preferably at least four times greater opening than that provided for condenser-evaporator pressure differentials of 80 psi. Thus, proper flow to the evaporator is obtained under the wide ambient temperature ranges and resulting wide variations in pressure and pressure differentials at the valve.

The compressor 12, condenser 14 and evaporator 16, along with the receiver 22, accumulator 26 and heat exchanger 30 are conventional and will not therefore be considered in greater detail herein. The balanced expansion valve 32 is illustrated in more detail in FIG. 2.

Figure 2:
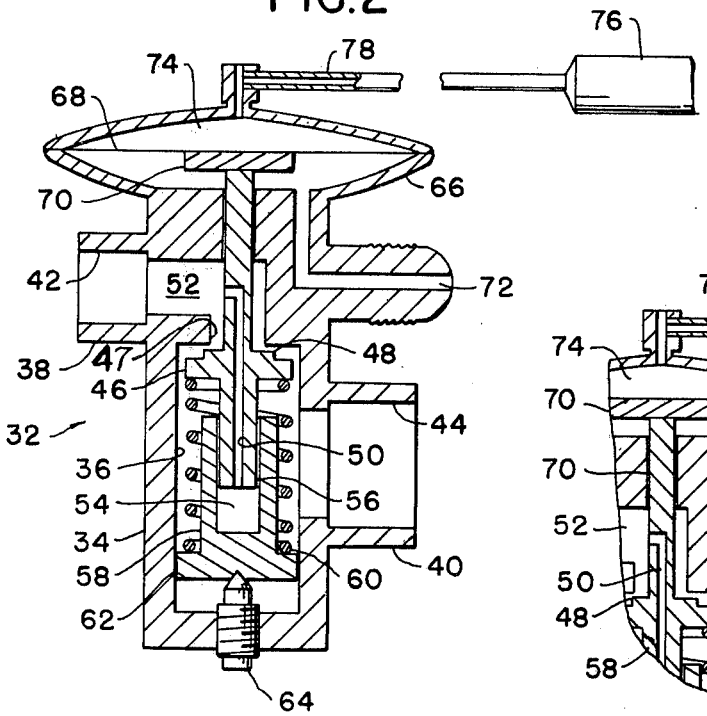
FIG. 2 is a longitudinal sectional view of a balanced expansion valve for use in a refrigeration system such as that illustrated in FIG. 1.

The expansion valve 32, as shown in FIG. 2, includes the valve body 34 having a central chamber 36 therein. The chamber 36 is connected at opposite ends of the valve body 34 with the coupling structure 38 and 40 adapted to be connected in the conduit 24 and including passages 42 and 44 therein in communication with chamber 36, as shown.

A flat valve element 46 is positioned in chamber 36 movable toward and away from port 47 and provides a port opening 48 in accordance with the position of the valve element 46 in the chamber 36. The valve element 46 is provided with a balancing opening 50 therethrough to provide equal pressures in chambers 52 and 54 to apply substantially equal forces to the oppositely facing surfaces of the valve element 46. The end 56 of the valve element 46 is received in the cup member 58 and forms in conjunction therewith the chamber 54, as shown in FIG. 2.

Spring 60 operates between the radial flange 62 on cup 58 and valve element 46, as shown, to bias the valve element 46 toward a closed position. In view of the balanced condition of the valve element 46 due to the equalizing of pressures in the chambers 52 and 54 on provision of the passage 50 through the valve element, the absolute value of the high side pressure in the chamber 52 does not affect the operation of the valve element 46. The low side pressure in chamber 36 is in a balanced force condition on valve element 46; however, it is not entirely essential since the low pressure force is nearly always the same for a system and its force acts with the spring 60 force.

The bias applied to the valve element 46 tending to maintain the valve member in a closed position may be adjusted by means of the superheat adjusting screw 64 received in the end of the body member 34 and engaged with the closed end of the cup 58, as shown in FIG. 2. Thus, the degree of superheat of the evaporator outlet may be controlled within limits on adjustment of the screw 64.

The motor means for actuating the valve element 46 to open the valve element 46 in opposition to the bias applied thereto by the spring 60 includes the diaphragm housing 66 secured to the valve body member 34 and diaphragm 68 secured in the housing 66 having the diaphragm plate 70 secured thereto in abutment with the upper end of the valve element 46, as shown in FIG. 2. The diaphragm 68 is exposed on the bottom side thereof through passage 72 and tube 73 to the pressure in the suction line 28, as shown in FIG. 2. The upper side of the diaphragm 68 is exposed to a pressure due to a temperature sensitive material 74 in the thermal bulb 76 and tube 78. The thermal bulb 76, as shown in FIG. 1, is positioned on the suction line 28 from the evaporator 16. Thus, the expansion valve 32, as indicated before, is directly responsive to the temperature and pressure of refrigerant leaving the evaporator 16.

Figure 3:
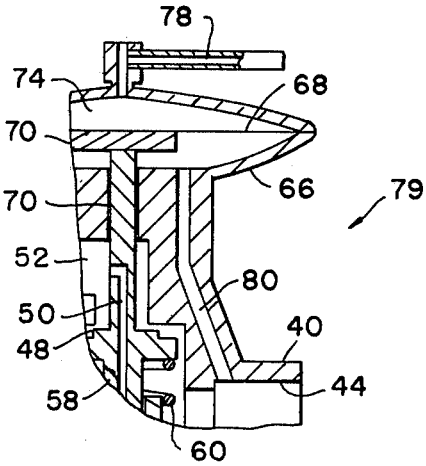
FIG. 3 is a partial sectional view similar to FIG. 2, of a modification of the expansion valve illustrated in FIG. 2.

In the modification 79 of the expansion valve 32 illustrated in FIG. 3 wherein similar elements have been given similar reference numerals, the diaphragm 68 is exposed on the underside thereof to the pressure of the refrigerant into the evaporator through the passage 80. Thus, as shown in FIG. 3, the expansion valve 79 is responsive to the input pressure of evaporator 16 and the output temperature thereof.

Figure 4:
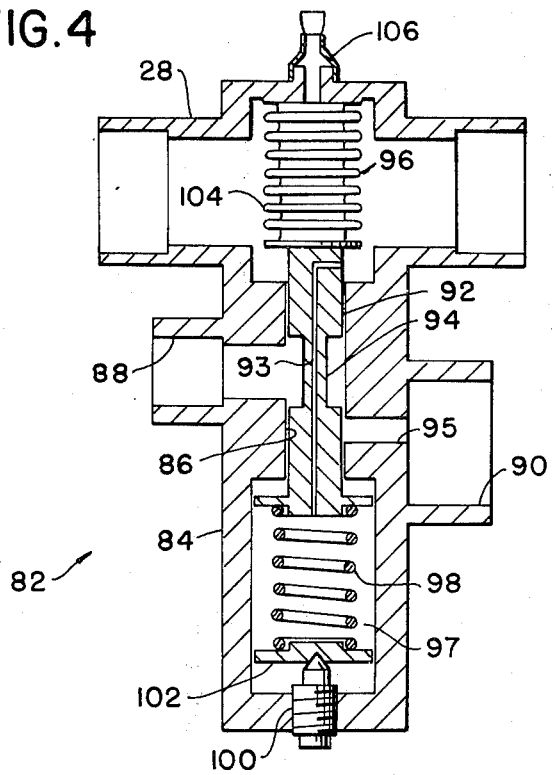
FIG. 4 is a longitudinal sectional view of a second balanced expansion valve for use in a refrigeration system, such as that illustrated in FIG. 1.

The expansion valve embodiment 82 shown in FIG. 4 may be substituted for the expansion valve 32. Expansion valve 82 includes the valve body 84 having passage 86 extending therethrough communicating with passages 88 and 90 on opposite sides thereof. The valve element 92 positioned in passage 86 has a reduced diameter central portion 94 whereby the high side pressures from the condenser 14 in the passage 88 are balanced. An equalizing passage 93 is provided in valve element 92 between spring chamber 97 and suction line 28 as shown so that suction pressure is applied to chamber 97. The passage 95 in valve body 84 again provides an oversized metering orifice in conjunction with valve element 92.

Thus, again with the valve 82, the valve element 92 is responsive primarily to the motor means 96 operating in opposition to the bias applied to the valve element 92 by the spring 93. The bias on valve element 92 is adjustable through the superheat adjusting screw 100 and cap 102. In the expansion valve 82 the motor means 96 is a bellows 104 engaged with the valve element 92 and charged with a temperature responsive fluid through charging means 106. The bellows 104 may be positioned directly in the suction line 28, as shown in FIG. 4 whereby the response time of the expansion valve 82 is maintained at a minimum.

Figure 5:
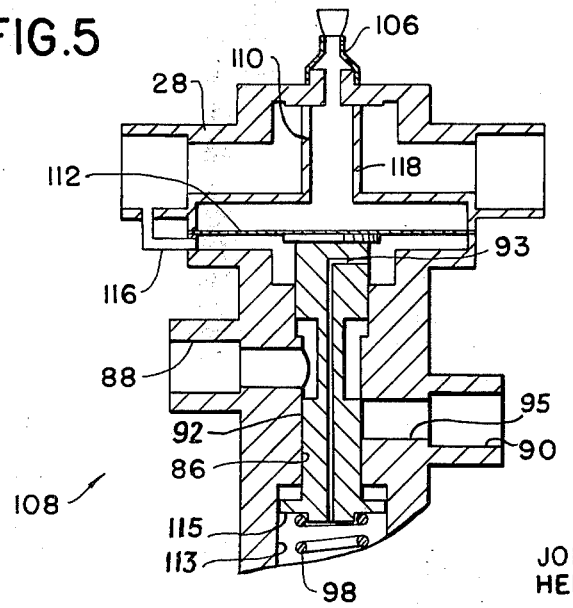
FIG. 5 is a partial sectional view similar to FIG. 4 of a modification of the expansion valve illustrated in FIG. 4.

The modified valve 108 illustrated in FIG. 5, wherein like elements have been given like reference numerals, is substantially the same as the valve 82, except for motor means 110, which includes a diaphragm 112 engaged with the valve element 92 centrally and exposed at the underside to the suction line pressure through tube 116. The diaphragm 112 is exposed on the upper side to temperature sensitive fluid from the thermal bulb 118 positioned in the suction line 28. Equalizing passage 93 connects the space at the underside of diaphragm 112 to chamber 113 where pressure of the condenser outlet is applied to the underside of piston-like portion 115 of the valve element.

The expansion valve 108 illustrated in FIG. 5 is overbalanced with respect to high side pressure due to the diameter difference at the opposite ends of valve element 92. Thus, a large pressure differential across the valve element 92 is present to balance the large pressure differentials between the condenser and evaporator in the summer time, while a considerably smaller pressure differential is provided across the valve element 92 in the winter time to balance the smaller pressure differential between the condenser and evaporator at this time. Under optimum sizing of the valve element 92 to the refrigeration system 10, the unbalance of the valve element 92 may be used to eliminate the spring 98 by substitution of overbalance bias therefor.

Figure 6:
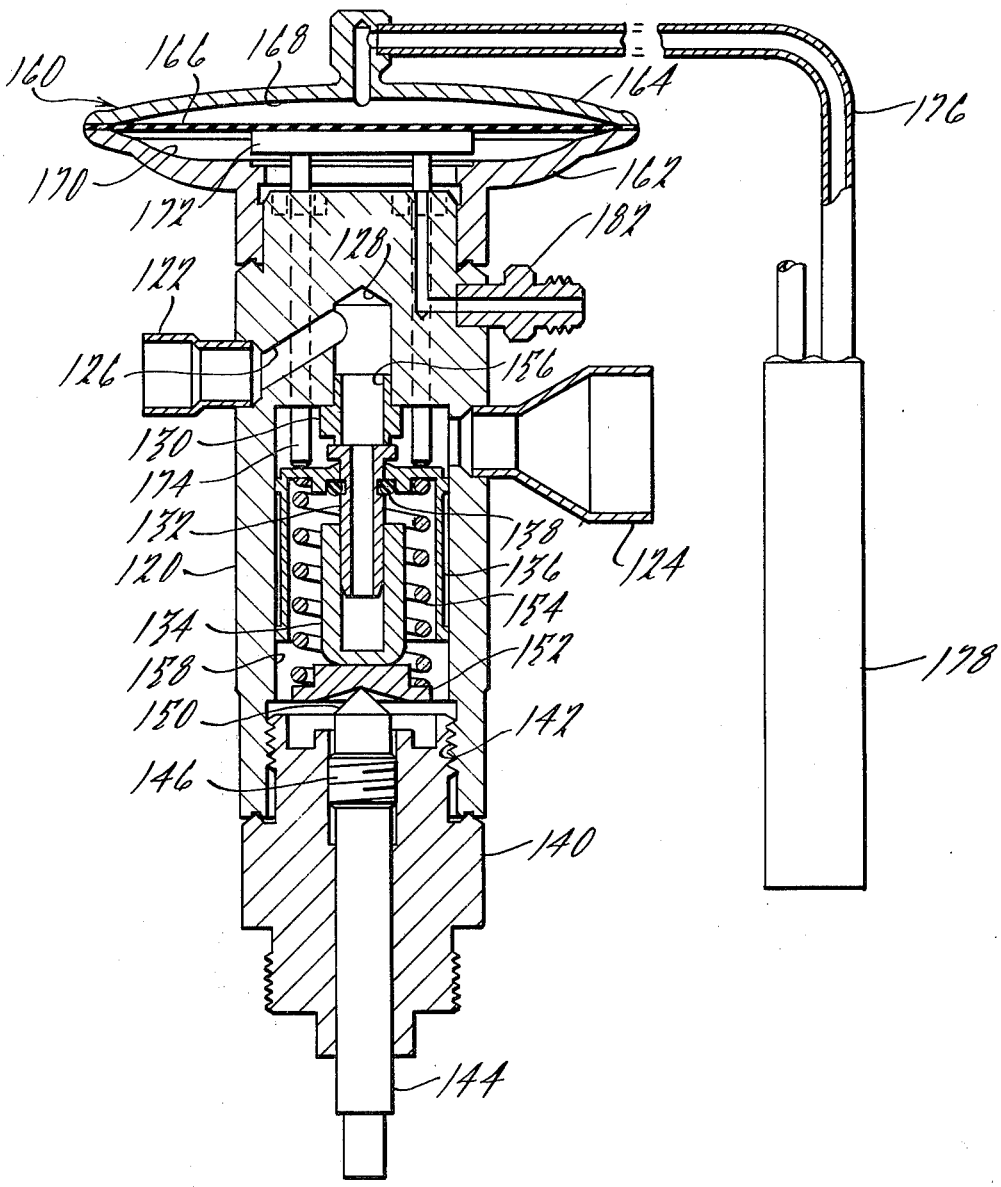
FIG. 6 is a sectional view through a somewhat different embodiment of expansion valve.

Referring now to FIG. 6 there is illustrated a specifically different embodiment of expansion valve in which the refrigerant flows into a tubular housing element 120 through a fitting 122 and exits from the housing 120 into a fitting 124 which may be a part of the evaporator. A passage 126 communicates with an enlarged passage 128 which receives a tubular valve seat 130 cooperating with a tubular valve element 132 the lower end of which is slidably received in a cup 134. The valve element 132 is sealingly coupled to an inverted cup-shaped carrier 136 by an O-ring indicated at 138.

The lower end of the tubular valve housing 120 is provided with a closure plug 140 threaded therein as indicated at 142. The plug 140 carries a vertically adjustable elongated element 144 which is threaded as indicated at 146 for longitudinal adjustment in the plug. The lower end of the element 144 is provided with a non-circular portion 148 by means of which vertical adjustment may be accomplished. The upper end of the element 144 is pointed as indicated at 150, and on the pointed end is provided a spring seat 152. Intermediate the spring seat 152 and the upper end of the carrier 136 is a compression spring 154 which is referred to as a superheat spring and which urges the valve element 132 upwardly into closing relation with respect to the port provided in valve seat 130.

It will be observed that inlet pressure existing within the enlarged passage or chamber 128 passes through the valve seat element 130 and the valve 132 into the interior of the cup 134. The internal diameter of the cup is equal or substantially equal to the diameter of the enlarged passage 156 extending through the valve seat 130. Accordingly, inlet pressure is active on equal oppositely facing areas of the valve element so that the valve is balanced with respect to what may be a relatively high inlet pressure up to as much as a few hundred psi.

At the same time, pressure prevailing within the chamber 158 is effective on the upper closed end of the cup-shaped carrier 136 and passages (not shown) connect the chamber 158 to the interior of the cup-shaped carrier so that it is also balanced with respect to the reduced pressures prevailing in the chamber 158.

Connected to the tubular valve housing element 120 is motor means designated generally at 160 and including a dished upwardly concave member 162 closed by a dished downwardly concave cover 164 between the edges of which is clamped a flexible diaphragm 166 defining an upper pressure chamber 168 and a lower pressure chamber 170. Connected to the diaphragm 166 is a rigid plate 172 carrying a plurality, as for example three, downwardly extending rods or pins 174 which engage the upper end of the valve carrier 136.

The upper chamber 168 is connected by a tube 176 leading to a bulb 178 containing a temperature responsive fluid. The lower chamber 170 is connected by a passage 180 formed in the valve housing 120 and an external fitting 182 to a source of pressure at the evaporator. This source of pressure may be evaporator inlet pressure or it may be evaporator outlet pressure, and is preferably the latter.

It will be observed that the spring seat 152 has point contact with the pointed end 150 of the element 144 and that accordingly, the movable valve structure including the carrier 136 as well as the valve element 132, is freely movable in response to changes in pressure within the chambers 168 and 170. Cup 134 and valve element 132 are movable so that the valve element may seat squarely despite possible unsymmetrical spring forces.

Figure 10:
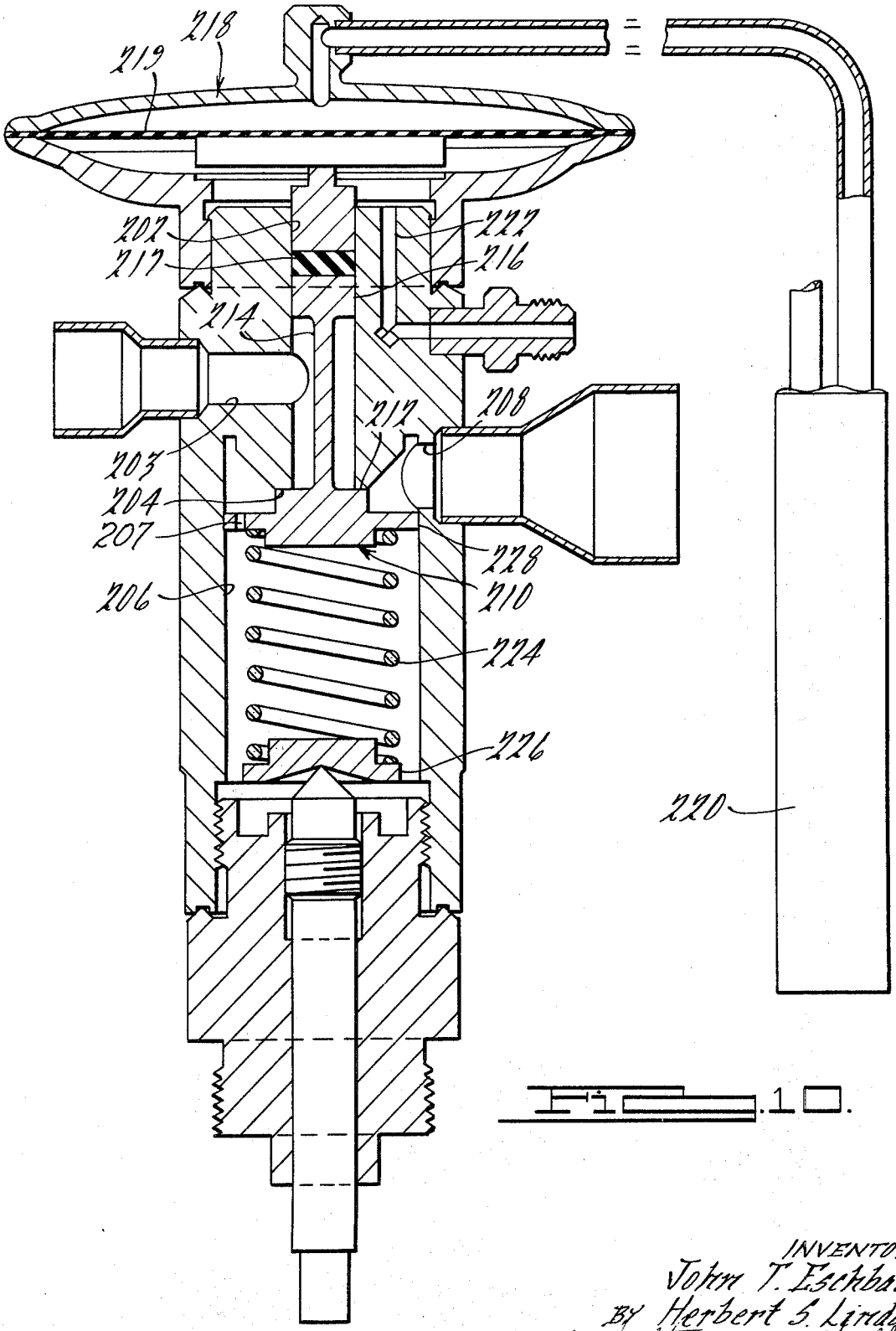
FIG. 10 is a sectional view through yet another specific valve.

The valve illustrated in FIG. 10 comprises a body 200 having a vertical cylindrical passage 202 connected to inlet passage 203 and terminating in a valve seat 204 surrounding the circular port formed by the lower end of passage 202. Below valve seat 204 is the enlarged chamber 206 which connects to the low pressure outlet passage 208.

Valve element 210 has a flat surface 212 engageable with valve seat 204 and movable relative thereto to meter the flow of refrigerant. The valve element has an annular groove 214 which receives high pressure liquid. The upper end of the valve element includes a piston-like head 216 engaging sealing disc 217 so that forces on the valve derived from high pressure liquid are substantially balanced. The valve element is connected to motor 218 in which the flexible diaphragm 219 is acted on by vapor pressure from bulb 220 at the top and low pressure from the evaporator through passage 222 at the underside. Superheat spring 224 acts between adjustable spring seat 226 and flange 228 on the valve element. Low pressure refrigerant acts on both sides of portions of the valve element in chamber 206, and provides substantial balance of these forces on the valve element.

In the expansion valve shown in FIGS. 2, 6 and 10, it will be observed that the port opening is equal to the circumference of the valve orifice, designated at 156 in FIG. 6, multiplied by the displacement of the valve from the seat. This arrangement provides for a maximum valve opening for a minimum amount of valve movement. It is of course possible to modify the valve action as for example, by including valve extensions which project into the opening in the valve seat.

In overall operation of the refrigeration system illustrated in FIG. 1, including any of the expansion valves illustrated in FIGS. 2, 6 or 10, efficient control of refrigerant flow through the expansion valve for a wide range of ambient temperature is made possible due to the provision for a maximum port opening much greater than heretofore used for a system of comparable capacity. Since the expansion valve is balanced, it operates properly during normal summer outside ambient temperature and at the same time operates efficiently in winter under low outdoor ambient temperatures without the necessity of changing the charge of refrigerant or building up artificial pressure heads across the expansion valve.

Another advantage of the provision for an unusually large valve opening under extreme conditions is that the system is thus capable of delivering an increased flow of refrigerant during start-up conditions, thus, being able to bring the refrigerated space to the required temperature in a much shorter period of time. The system reduces operating cost during low ambient conditions at the condenser since the efficiency of the compressor increases at the lower pressure heads and the increase in heat exchange effect from the flow of each pound of refrigerant. Also, the system provides a better control of refrigerant flow so that the evaporator can be fed better with low superheat leaving the evaporator, or even completely wetted internal coil surface throughout the evaporator for increased efficiency, or in other words, zero superheated vapor.

Referring now in general terms to the overall improvement in the system, it is the purpose of the present invention to control the flow rate of liquid refrigerant entering the evaporator in response to the temperature of the refrigerant gas leaving the evaporator, and the pressure of the gas leaving the evaporator by means of a thermostatic expansion valve designed to control the proper flow rate at extreme pressure differentials across the valve such for example from 10 to 300 psi, while maintaining the evaporator in an evenly flooded or entirely active condition, without permitting unevaporated refrigerant to leave the evaporator to be returned through the suction line to the compressor. The foregoing is rendered possible for a particular system by design of a thermal expansion valve characterized in size or diameter of the valve port (preferably oversize as compared to ports of prior valves designed for systems of comparable capacity), and in control means for the valve element which results in substantially greater increase in valve opening upon reduction in refrigerant pressure at the inlet to the expansion valve than has hitherto been possible. The valve accordingly regulates the refrigerant flow to provide rated capacity of the system through a range of ambient temperature far greater than heretofore possible.

The design and selection of operating characteristics of the expansion valve is based on the following discussion:

Prior to the present invention, the art of thermostatic expansion valves has employed port openings which are carefully sized at near maximum capacity of the port at the higher pressure differentials prevailing during normal summer operation at maximum designed capacity of the system.

To illustrate the application of a conventional expansion valve, an R502 refrigeration system has been selected for cooling a low temperature room to a temperature of −10° F. The cooling effect required is 1.65 tons refrigeration (19,500 BTU per hour) with summer design ambient conditions 90° F. A 5 HP compressor, condenser unit and evaporator unit would then be selected to meet these conditions. It would be typical at the 90° F. ambient to have a saturated condensing temperature at the condenser inlet of 108° F. (254 psia) and to have a saturated temperature leaving the evaporator of −20° F. (31 psia). The selection of a thermostatic expansion valve would be based on the ratings applied to the valve at −20° F. If we examine published ratings we would select a thermostatic expansion valve of conventional design of nominal 2-ton rating which is rated as follows:

| | Pressure Drop Across Valve (Pounds per Sq. Inch) | | | | | |
|---|---|---|---|---|---|---|
| | 100 | 120 | 140 | 160 | 180 | 200 |
| TONS CAPACITY* | 1.68 | 1.7 | 1.76 | 1.76 | 1.76 | 1.78 |

*at −20° F. evaporator temperature and saturated liquid entering the expansion valve.

In the conditions being examined with the above system there is a pressure difference between entering the condenser and leaving the evaporator of 223 psi (254–31). In conventional system design we might expect typical pressure drops through various parts of the system of 3 psi in the condenser, 1 psi in the liquid line, 20 psi in the evaporator distributor and 1 psi in the evaporator, or a total of 25 psi. Therefore, the pressure drop across the expansion valve would be 198 psi. The rating of 1.78 tons at 200 psi pressure drop across the valve will meet the requirements for this system at this condition.

We next examine the conditions of the valve at 100 psi pressure drop across the valve to determine the lowest limit at which the valve will feed the coil before it results in decreased capacity and in increase in superheat at the evaporator.

In continuing this examination, reference will be made to the charts in FIGS. 7 and 8.

Evaporator unit capacity ratings as illustrated in FIG. 8, are determined by the BTUs the evaporator will remove, based on a temperature difference between the return air temperature entering the coil and the refrigerant temperature in the evaporator. The particular curve illustrated in FIG. 8 is based on a −10° F. room temperature. As the suction temperature becomes lower the evaporator capacity increases because the temperature difference has increased since we are maintaining the same −10° F. room temperature. Therefore, at −20° F. evaporator temperature we have 10° temperature difference. At −30° F. we have 20° temperature difference. The evaporator capacity at −30° F. becomes about 2 times the capacity at −20° F., giving us the slope of the evaporator capacity shown in FIG. 8. The intersecting lines on this chart represent the condensing unit (compressor-condenser) capacities at −20°, 54°, and 90° F. ambient at the condenser. The compressor capacity is effected by volumetric efficiency from the compression ratio between entering and leaving absolute pressures and the density of the vapor returning to the compressor. The density of the vapor is the result of the suction pressure entering the compressor which is determined by the temperature of the room being cooled and the balance of capacity between the condensing unit and the evaporator. The capacity at the compressor which is determined by tests and published by the compressor manufacturers may be converted to the flow of refrigerant as measured in pounds per minute.

Reference is made herein to effective port opening and it is to be understood that this in general refers to the actual opening as determined by relative movement between the valve element and the valve port, which in turn determines the rate of flow of refrigerant under any given set of conditions. It is of course understood that actual flow may be influenced by the shape of the port opening. For example, in the valve illustrated in FIGS. 2 and 6, the shape of the effective port opening is annular and its area is equal to the circumference of the valve port multiplied by the displacement of the valve element from its seat. This all becomes a part of the design criteria of a particular valve which then is given a capacity rating on its ability to flow a particular refrigerant with a maximum variation in superheat of 7° F. or less. (See ARI Standard 750–70 Paragraph 5.3). The valve is also rated at various pressure differentials at the different evaporator temperatures. For refrigerant R12 this is normally between 40 to 160 psi pressure differential, and for R22 and R502 between 60 and 200 psi pressure differential. The port opening decreases as the operating temperature decreases because of characteristic relation that $\Delta P$ of the refrigerant decreases per degree Fahrenheit as the operating temperature decreased. This however, is a normal characteristic of expansion valves and as will be described in conjunction with FIG. 7, conventional normal port openings as provided in thermal expansion valves commonly used prior to the present invention, are inadequate for the low pressure differentials at low ambient temperatures at the condenser.

Referring now to capacity balance curves of FIG. 8 at various condensing pressures resulting from the ambient at the condenser, the approximate condition found in the above system would be 73° F. condensing temperature (158 psia) at 54° F. ambient with the leaving evaporator conditions 27 psia (−23° F. saturated temperature). The system capacity will be approximately 2.22 tons (26,700 BTU per hour), as indicated at point P*a* in FIG. 8. Referring to the valve capacity data above, we note that the capacity of the valve has been exceeded with this system at 100 psi pressure drop across the valve, and the superheat must then increase above design conditions. This results in underfeeding the evaporator and the start of a starved condition begins.

Next we will examine the conditions at an outdoor ambient at −20° F. at the condenser. The evaporator, condenser and compressor units will balance at 25.5 psia (−28° F. saturated temperature) leaving the evaporator. The condenser inlet pressure will be approximately 46 psia. The total pressure differential in the system under these conditions is 20.5 psi. The pressure drop in the condenser, liquid line, distributor and evaporator will be reduced to approximately 5 psi total. The pressure drop across the expansion valve in this instance will be 15.5 psi. The refrigeration system capacity has now greatly increased to 3.3 tones (39,700 BUT per hour) or point P*b* as shown in FIG. 8.

The foregoing establishes that thermal expansion valves as used in refrigeration systems prior to the present invention are inadequate to provide sufficient flow of refrigerant under the low pressure conditions existing at low winter time ambient temperatures and indicate the necessity for thermal expansion valves which will not only be adequate to control refrigerant flow during the relatively high liquid pressure conditions found during summer time, but which also will provide the much greater increase in port opening required during winter time conditions.

The capacity rating of a refrigeration system and the expansion valve may also be expressed in flow of refrigerant, as for example in pounds per minute, required, assuming saturated liquid conditions entering the expansion valve and saturated vapor conditions leaving the evaporator. The flow rate is expressed in the following equation:

$$W = Q \div 60 \times (H_1 - h_2)$$

where, $W$ = Pounds refrigerant per minute, $Q$ = Total heat removed by evaporator (BTU per hour), $H_2$ = Enthalpy of liquid entering expansion valve (BTU/LB), $h_1$ = Enthalpy of saturated vapor leaving evaporator (BTU/LB).

In the system referred to above, whose performance is indicated in the chart of FIG. 8, the refrigerant flow rate at three varied ambients is as follows:

| | | |
|---|---|---|
| 90°F. ambient | W = 19,500 ÷ 60 × (77.82 − 45.29) = | 10 lbs/min. |
| 54°F. ambient | W = 26,700 ÷ 60 × (77.42 − 32.84) = | 9.98 lbs/min. |
| −20°F. ambient | W = 39,700 ÷ 60 × (76.76 − 10.82) = | 10.05 lbs/min. |

It will be observed that the refrigerant flow rate under this relatively wide range may be regarded as substantially constant. Accordingly, in order to maintain the substantially constant flow rate, it becomes immediately apparent that the port opening under the low pressure drop available across the expansion valve under extremely low temperature ambient conditions must be greatly increased over the port opening sufficient to provide a substantially equal flow under high pressure conditions prevailing during summer time.

The expansion valve rating for the valve selected above may also be expressed in pounds of refrigerant flow per minute. In FIG. 7, Curve 1 illustrates the conventional valve rating at design conditions as flow rate in pounds per minute at a range of pressure drop across the valve.

The conventional valve whose performance is indicated by Curve 1 is a nominal 2-ton size with an appropriate orifice diameter of 0.125 inches with a stroke of approximately 0.015 inches at the −20° F. evaporator temperature at a maximum operating superheat of 7° F. The flow rate required in the system in pounds per minute remains approximately the same to satisfy a full active evaporator when the condenser is subject to ambients in the range of −20° F. to 90° F. temperature. The nominal 2-ton thermostatic expansion valve will not meet the requirements of this range of conditions. It will be observed that in FIG. 7 the required rate of refrigerant flow is maintained only when the pressure drop is above approximately 140 psi.

Curve 2 illustrates results using a valve having a maximum port opening approximately twice that of the conventional nominal 2-ton valve. This valve, as appears in FIG. 7, has a capacity to feed the evaporator properly at a much lower pressure drop across the valve than the valve of Curve 1. Specifically, this valve will feed the evaporator properly down to a pressure drop across the expansion valve of substantially less than 40 psi. It will be apparent of course that, where the size or diameter of the port is oversize, the valve of Curve 2 will be required to operate with its valve element much closer to its seat under the high pressure drop conditions than the valve of Curve 1, but its performance under these conditions is properly controllable by the means responsive to evaporator outlet temperature and pressure conditions, in conjunction with the superheat spring, and by means of a balanced valve element to provide efficient control of refrigerant in the amount required.

Curve 3, as illustrated in FIG. 7, illustrates performance of a valve having a maximum port opening four times that of the valve of Curve 1. It will be observed that this valve will operate satisfactorily to feed the evaporator properly down to a pressure difference of approximately 10 psi.

The improved construction of thermal expansion valve in which the valve element can modulate close to the valve seat, combined with a larger valve port, so as to result in a larger port opening at maximum operating valve movement, provides the requirements for the ability to control the flow at the extreme pressure differentials described above. In order for the valve to modulate properly close to the valve seat, it is necessary to eliminate the effect of the liquid inlet pressure against the valve element by equalizing the pressures exerted against the valve element so that the high side, and preferably also the low side forces have little or no effect in the opening or closing of the valve element. Therefore, the valve spring force urging the valve element closed is always in the same relationship to the motor element force urging the valve element open.

Additionally, the construction of a balanced thermal expansion valve in which the valve element can modulate close to the valve seat makes possible the satisfactory operation of the valve for conditions in which the evaporator capacity, and thereby the required refrigerant flow rate, is greatly reduced from design conditions while the system is operating at a given outdoor ambient condition. For example, this situation occurs when the required refrigeration load changes in the refrigerated space being cooled by the evaporator caused by such items as an influx of warm product to the refrigerated space followed by a period of storage only of the cooled product and the compressor includes an unloading device to reduce its capacity as the refrigeration load reduces.

Because of the improved construction with a larger port opening, this valve will properly modulate and feed refrigerant to the evaporator as the refrigeration load changes during periods of low pressure drop across the valve in the winter time as well as during periods of high pressure drop across the valve in the summer time. During summer ambients there are the conditions of high heat loads at which the large port opening allows rapid pull down because of its greater capacity than required for design conditions. Stated in other words, the improved construction of thermal expansion valve provides for a fully active evaporator and without flood-back to the compressor at all combinations of different pressure drops across the valve and different refrigeration load requirements. It becomes obvious that with the improved balanced thermal expansion valve construction that less number of sizes of thermal expansion valves are required for a range of system capacities because the valve provides excellent control over a wide range of application.

A further improved performance is obtainable by adjusting the valve element spring force so that zero degree superheat is obtained leaving the evaporator which heretofore has been found impossible to obtain with a thermal expansion valve.

The combination of 0° Fahrenheit super-heat, an oversized valve port which provides for the much larger port opening under low pressure drop conditions, and equalizing the refrigerant pressure forces against the valve element is unique and different. It provides a breakthrough so that the head pressure controls are no longer necessary when condensers are subject to extreme outdoor ambient temperatures as are found for example in North Dakota during winter and summer seasons. Also, the present invention provides for the added improvement of a fully active evaporator with saturated vapor leaving the evaporator without flood-back to the compressor.

A further important advantage of the present system employing the oversized valve construction is that under start-up conditions the refrigerant supply is sufficient to bring the system to normal operating conditions much more rapidly than has heretofore been possible.

Table A shows a specific example of a system designed in accordance with the teachings herein:

TABLE A

| ΔP | Port Opening* | Refrigerant 502, Flow Rate** | Tons Capacity** | Evaporator Temperature | Ambient at Condenser |
|---|---|---|---|---|---|
| 200 | .035 | 10 lb/min. | 1.64 | −20°F. | 90°F. |
| 140 | .040 | " | 2.14 | −22.5°F. | 65°F. |
| 100 | .047 | " | 2.42 | −23.5°F. | 46°F. |
| 80 | .051 | " | 2.58 | −24.5°F. | 33°F. |
| 60 | .059 | " | 2.75 | −25.5°F. | 19°F. |
| 40 | .071 | " | 3.0 | −26.5°F. | 0°F. |
| 20 | .099 | " | 3.3 | −28°F. | −18°F. |
| 10 | .139 | " | 3.4 | −29°F. | −28°F. |

ΔP — Pressure drop across expansion valve.

*Port opening — cross-sectional area in square inches between valve element and valve port when valve element is stroked with a maximum change of 7° F. superheat beyond valve opening point. Port opening may vary some with different designed valve ports and valve elements which changes the velocity and discharge coefficients.

**Based on saturated liquid entering with thermostatic expansion valve.

This system is a 5 horsepower low temperature system designed to maintain a space temperature of −10° F. and is the specific system under consideration heretofore. Accordingly, the invention may be considered as residing in a system employing a thermostatic expansion valve the characteristics of which are selected in accordance with the conditions of the system to bear the same relationship thereto as the valve disclosed in Table A bears to its system.

In this system it will be noted that the port opening with an outdoor ambient temperature of −28° F. is approximately four times as great as the port opening when the ambient temperature at the condenser is 90° F.

It may be noted that prior to the present invention, thermal expansion valves having rated conditions of 60–200 psi pressure drop across the valve for R22 and R502 (40–160 psi for R12) had a refrigerant flow rate 70% or more under these rated conditions of the maximum flow rate capability of the valve. In accordance with the present invention the thermostatic expansion valve is designed to have a flow rate less than 70% of the maximum flow rate capability of the valve at said conditions. This may be stated conversely to indicate the essential difference in the capability of providing a greatly increased effective port opening or flow rate capability under maximum flow capability conditions existing under extremely low ambient temperature and correspondingly low available pressure drop across the expansion valve. In this terminology, the maximum flow capability of the thermal expansion valves employed in the systems disclosed herein, is more than 142% of the flow capability under the conventional rated conditions of 60–200 psi for R22 and R502, and 40–160 psi for R12.

The essential differences in the system, which resides in the specific difference in the thermostatic expansion valve, may be briefly reviewed.

In the first place, the improvement may be referred to generally as residing in an expansion valve having a maximum port opening at least twice, and preferably at least four times the maximum port opening of prior conventional thermostatic expansion valves of comparable capacity.

Viewed from another standpoint, the present invention may be regarded as residing in the use of a thermal expansion valve designed to have a maximum port opening under extreme low temperature ambient conditions to produce a refrigerant flow substantially in excess of 142% of the refrigerant flow under pressure drop "rated conditions" (60–200 psi for R22 and R502, and 40–160 psi for R12).

From Table A it will be noted that in a typical system, which may be considered as representative of any system embodying the substance of the present invention, the flow rate of refrigerant in pounds per minute is substantially constant throughout the entire temperature range investigated. Accordingly, one aspect of the present invention may be considered as a system in which the expansion valve is dimensioned and arranged and the performance of the valve opening means is such as to maintain an approximately constant rate of flow of refrigerant throughout a much wider range of temperature variations than heretofore possible, the flow being measured in pounds per minute.

Referring again to the representative disclosure of Table A, it may be noted that prior to the present invention systems were available which operated satisfactorily under summer time conditions with a high ambient, for example in the neighborhood of 90° F., down to a lower ambient temperature of about 50° F. It is only below these temperatures where the prior systems failed to supply adequate refrigerant to the evaporator coil to maintain the coil active throughout its entire length. Accordingly, the invention may be further considered as residing in a system including an expansion valve in which the dimensions and arrangement of the valve port and valve element and the performance of the valve operating means are selected such that throughout a substantial range, as for example 70° F. and down to relatively low ambient temperature conditions such for example as 20° F., 0° F., −20° F., etc., the refrigeration system remains in balance with the amount of refrigerant passed by the expansion valve being just sufficient to maintain substantially the entire evaporator in active condition without either starving the evaporator and producing excessive superheat in the refrigerant gas leaving the evaporator, or providing excess refrigerant so that not all of the refrigerant evaporates in the evaporator and some escapes from the evaporator in liquid phase.

From still another standpoint, and without reference to dimensions or performance of prior expansion valves, the present invention may be said to reside in a system having a thermal expansion valve in which the port opening is variable in accordance with ambient temperature at the condenser and pressure drop across the expansion valve such that the port opening at 0° F. ambient temperature and 40 psi pressure drop across the condenser is approximately double, and at least 1.5 times the port opening at 90° F. ambient temperature at the condenser and 200 psi pressure drop.

Restated to include more severe winter conditions, the invention may be said to reside in a system using a thermal expansion valve having a port opening under ambient temperature conditions of −28° F. and a pressure drop across the expansion valve of 10 psi, which is approximately four times and at least three times the port opening under ambient temperature conditions at the condenser of 90° F. and a 200 psi pressure drop across the expansion valve.

It will of course be apparent that Table A above represents a particular set of conditions and can serve as a guide to the selection of actual design and operating characteristics of an expansion valve for a different system. Thus for example, the values of $\Delta P$ which are given are those obtained with the refrigerant 502, will be specifically different if different refrigerants are used, but they will be roughly proportional.

Accordingly, FIG. 9 of the drawings shows a curve in which the actual port openings as enumerated in Table A, are plotted against ambient temperatures at the condenser. This curve may be used as a guide in designing the valve and particularly the valve port and valve element and the associated valve operating means, so as to maintain a minimum ratio between port openings at any moderate ambient temperature and a much lower ambient temperature approximately equal to the ratio derived from FIG. 9.

What we claim as our invention is:

1. A thermostatically controlled expansion valve for use in a refrigeration system comprising an elongated body having an opening extending therethrough from end to end, said opening having intermediate its ends an abrupt change in cross-sectional area defining a shoulder forming a valve seat, and an enlarged outlet chamber at one side of said valve seat, the portion of said opening at the other side of said shoulder forming a cylindrical guide passage of uniform cross-section, and forming a valve orifice at said shoulder whose cross-sectional area is equal to the cross-sectional area of said guide passage, an elongated valve element having a piston-like head movable in said cylindrical guide passage and an enlarged valving portion movable within said chamber to form a variable restriction with said valve seat and adapted to seat against said valve seat to close said orifice, the portion of said valve element intermediate said head and said enlarged valving portion being reduced to define with the surrounding portion of said guide passage an annular inlet chamber, an inlet passage communicating with said inlet chamber, motor means carried at the end of said body containing said guide passage and forming a closure therefor, said motor means comprising a flexible diaphragm operatively mechanically connected to said valve element, a connection for applying pressure to said diaphragm variable with evaporator outlet temperature in a direction tending to open said valve, and a connection for applying pressure to said diaphragm variable with evaporator pressure tending to close said valve, adjustable spring means in said outlet chamber engaging said valve element and urging it in valve closing direction, the high pressure existing within said inlet chamber being substantially balanced as a result of applying a valve closing force to said head and a valve opening force to the portion of the valving portion of said valve element exposed at the valve orifice, said outlet chamber being cylindrical, said valve element including a guide portion engaging the periphery of said outlet chamber.

2. A valve as defined in claim 1 in which the guide portion of said valve element comprises a flange of circular shape fitting within said outlet chamber, and means providing for a pressure equalizing flow of low pressure refrigerant past said flange.

3. A valve as defined in claim 2 in which the flange of said valve element has a central spring locating projection integral therewith, said spring engaging the side of said flange remote from said valve port and centralized by said projection.

4. A thermostatically controlled expansion valve for use in a refrigeration system comprising an elongated body having an opening extending therethrough from end to end, said opening having intermediate its ends an abrupt change in cross-sectional area defining a shoulder forming a valve seat, and an enlarged outlet chamber at one side of said valve seat, the portion of said opening at the other side of said shoulder forming a cylindrical guide passage of uniform cross-section, and forming a valve orifice at said shoulder whose cross-sectional area is equal to the cross-sectional area of said guide passage, an elongated valve element having a piston-like head movable in said cylindrical guide passage and an enlarged valving portion movable within said chamber to form a variable restriction with said valve seat and adapted to seat against said valve seat to close said orifice, the portion of said valve element intermediate said head and said enlarged valving portion being reduced to define with the surrounding portion of said guide passage an annular inlet chamber, an inlet passage communicating with said inlet chamber, motor means carried at the end of said body containing said guide passage and forming a closure therefor, said motor means comprising a flexible diaphragm operatively mechanically connected to said valve element, a connection for applying pressure to said diaphragm variable with evaporator outlet temperature in a direction tending to open said valve, and a connection for applying pressure to said diaphragm variable with evaporator pressure tending to close said valve, adjustable spring means in said outlet chamber engaging said valve element and urging it in valve closing direction, the high pressure existing within said inlet chamber being substantially balanced as a result of applying a valve closing force to said head and a valve opening force to the portion of the valving portion of said valve element exposed at the valve orifice, said valve element comprising a reduced stem extending from said head through said valve orifice, a valving portion adjacent said valve seat, a radially enlarged guide portion slidable in guided relation to said outlet chamber, and means providing for a pressure-equalizing flow of refrigerant to opposite sides of said guide portion.

5. A valve as defined in claim 4 in which said valve element includes a spring centering portion at the side of said guide portion remote from said valve orifice.

6. A thermostatically controlled expansion valve for use in a refrigeration system comprising an elongated body having an opening extending therethrough from end to end, said opening having intermediate its ends an abrupt change in cross-sectional area defining a shoulder forming a valve seat, and an enlarged outlet chamber at one side of said valve seat, the portion of said opening at the other side of said shoulder forming a cylindrical guide passage of uniform cross-section, and forming a valve orifice at said shoulder whose cross-sectional area is equal to the cross-sectional area of said guide passage, an elongated valve element having a piston-like head movable in said cylindrical guide passage and an enlarged valving portion movable within said chamber to form a variable restriction with said valve seat and adapted to seat against said valve seat to close said orifice, the portion of said valve element intermediate said head and said enlarged valving portion being reduced to define with the surrounding portion of said guide passage an annular inlet chamber, an inlet passage communicating with said inlet chamber, motor means carried at the end of said body containing said guide passage and forming a closure therefor, said motor means comprising a flexible diaphragm operatively mechanically connected to said valve element, a connection for applying pressure to said diaphragm variable with evaporator outlet temperature in a direction tending to open said valve, and a connection for applying pressure to said diaphragm variable with evaporator pressure tending to close said valve, adjusting spring means in said outlet chamber engaging said valve element and urging it in valve closing direction, the high pressure existing within said inlet chamber being substantially balanced as a result of applying a valve closing force to said head and a valve opening force to the portion of the valving portion of said valve element exposed at the valve orifice, in which the mechanical connection between said diaphragm and valve element comprises an element connected to said diaphragm and slidable in said guide passage, and a flat sealing disc interposed between said element and said valve head in said guide passage.

* * * * *